US007356121B2

(12) United States Patent
Schwarz

(10) Patent No.: US 7,356,121 B2
(45) Date of Patent: Apr. 8, 2008

(54) SYSTEM AND METHOD FOR SUPPLYING POWER TO X-RAY IMAGING SYSTEMS

(75) Inventor: Armin R. Schwarz, Sandy, UT (US)

(73) Assignee: General Electric Company, Schenectady, NY (US)

( * ) Notice: Subject to any disclaimer, the term of this patent is extended or adjusted under 35 U.S.C. 154(b) by 147 days.

(21) Appl. No.: 11/269,359

(22) Filed: Nov. 8, 2005

(65) Prior Publication Data

US 2007/0104318 A1 May 10, 2007

(51) Int. Cl.
*H05G 1/10* (2006.01)

(52) U.S. Cl. ..... 378/101; 378/117

(58) Field of Classification Search ..... 378/101, 378/114, 117, 207
See application file for complete search history.

(56) References Cited

U.S. PATENT DOCUMENTS 5,867,561 A * 2/1999 Strasser et al. ..... 378/98.2
6,111,931 A 8/2000 Kusch ..... 378/106
2005/0028014 A1 2/2005 Allred et al. ..... 713/300

FOREIGN PATENT DOCUMENTS

EP 0 894 472 A2 3/1999
EP 1 503 474 A1 2/2005

* cited by examiner

*Primary Examiner*—Courtney Thomas
(74) *Attorney, Agent, or Firm*—McAndrews, Held & Malloy, Ltd.; Peter J. Vogel; Michael A. Dellapenna

(57) ABSTRACT

Certain embodiments of the present invention provide a method for providing power to an x-ray imaging system including: sensing an electrical signal from a second power source; and routing the electrical signal from the second power source through at least one switch to an x-ray imaging system in response to the sensing an electrical signal from the second power source, wherein the at least one switch is capable of routing an electrical signal from at least one of: a first power source and the second power source. In an embodiment, the method further includes communicating a feature lockout signal to the x-ray imaging system in response to the sensing the electrical signal from the second power source. In an embodiment, the method further includes detecting the status of a safety sensor before routing the electrical signal from the second power source through the at least one switch.

20 Claims, 3 Drawing Sheets

SYSTEM AND METHOD FOR SUPPLYING POWER TO X-RAY IMAGING SYSTEMS

BACKGROUND OF THE INVENTION

Embodiments of the present application relate generally to systems and methods for supplying power to x-ray imaging systems. Particularly, certain embodiments relate to a mobile x-ray imaging system that adaptively accommodates a plurality of power source options.

X-ray imaging systems have a variety of power consuming components. For example, x-ray imaging systems may have x-ray generation components, x-ray detection components, data processing components, and image display components. Each component may have a power consumption characteristic that varies from the other components. For example, an x-ray generation component such as an x-ray generation power supply may consume a relatively large amount of power as compared to data processing components, such as a central processing unit ("CPU"). Additionally, each component may consume a varying amount of power, depending on the operating mode of an x-ray imaging system. For example, an x-ray imaging system operated to acquire a single still image may consume less power than the same system operated continuously or periodically (e.g. cine mode or fluoroscopy).

Certain x-ray imaging system components are known to consume a relatively large amount of power. For example, to generate x-rays, power supplies may be required to operate at high voltages and powers to create x-ray energy. As another example, cooling systems may be required by some x-ray detectors. Cooling systems for x-ray detectors may consume relatively large amounts of power. Additionally, the power consumption characteristics may change dramatically for components such as x-ray power supplies and cooling systems depending on the mode of operation of the x-ray imaging system. For example, one mode of operation of an x-ray imaging system may be oriented towards imaging the cervical, thoracic and lumbar spines for placing a needle to treat a pain causing structure. This "pain management" mode may require less power than an x-ray imaging mode designed to image higher density bone tissues. Other low power x-ray procedures include general fluoroscopic applications like orthopedic procedures where only occasional short duration x-ray exposures may be required. Another mode of x-ray imaging may involve imaging the heart such as coronary angiography. In such an application, relatively high power pulsed x-rays may be required for reducing heart motion artifacts to yield improved image quality on a moving heart. Cardiology applications may also require relatively long x-ray exposure times which may increase the average system power requirements.

Generally, in North America, electrical power is most readily available in the form of 115 VAC, although actual power bus voltage levels may vary. A higher voltage of 208 VAC is also generally available in North America (again, actual power bus voltage levels may vary). The 208 VAC supply has an advantage of being able to provide more power than 115 VAC supply for a given amperage. At least for this reason, it may be advantageous to design x-ray imaging systems to operate from a 208 VAC supply.

Notwithstanding some benefits of higher voltage power sources, 208 VAC outlets may be more expensive to install and wire, and may be rarer than 115 VAC outlets. The 208 VAC outlet may only be readily found in a location for which specific 208 VAC demand is present (e.g. a kitchen, laundry room, operating room, etc.). Some locations, such as on the floor of a tradeshow, may not have readily available 208 VAC outlets. Indeed, many locations may only have 115 VAC outlets readily available, and it may be cost-prohibitive or inefficient to have 208 VAC wired to a particular location.

The advent of mobile x-ray imaging systems has allowed a user to relocate an x-ray imaging system with relative ease. For some clinical applications, it may be efficient to supply the mobile x-ray imaging system with 208 VAC. However, for other clinical and demonstrative applications, a 115 VAC source may suffice. In addition to 115 VAC and 208 VAC, which are typically single-phase sources, other power supplies may be available for powering a mobile x-ray imaging system, such as 240 VAC for international markets, 277 VAC three-phase, and 480 VAC three phase, for example.

Thus, there is a need for methods and systems that generally improve the geographical penetration of mobile x-ray imaging systems. There is a need for methods and systems that flexibly provide electrical power to an x-ray imaging system based on the availability of various electrical power sources. Additionally, there is a need for methods and systems that automatically recognize a type of power source (e.g. 115 or 208 VAC) that is being used to power an x-ray imaging system. Moreover, there is a need for methods and systems that prevent x-ray imaging systems from overdrawing power beyond the capacity of an available power source.

BRIEF SUMMARY OF THE INVENTION

Certain embodiments of the present invention provide a method for providing power to an x-ray imaging system including: sensing an electrical signal from a second power source; and routing the electrical signal from the second power source through at least one switch to an x-ray imaging system in response to the sensing an electrical signal from the second power source, wherein the at least one switch is capable of routing an electrical signal from at least one of: a first power source and the second power source. In an embodiment, the method further includes communicating a feature lockout signal to the x-ray imaging system in response to the sensing the electrical signal from the second power source. In an embodiment, the method further includes detecting the status of a safety sensor before routing the electrical signal from the second power source through the at least one switch. In an embodiment, a power module is capable of performing the sensing of signal from the second power source. In an embodiment, a power module is capable of communicating the feature lockout signal. In an embodiment, the routing the electrical signal from the second power source through at least one switch is performable by at least one of: applying a control signal to one of the at least one switch; and removing the control signal from one of the at least one switch. In an embodiment, the first power source is capable of sourcing more power than the second power source. In an embodiment, an average voltage of the first power source is greater than an average voltage of the second power source. In an embodiment, the feature lockout signal includes a communication to reduce power consumption of at least one component of the x-ray imaging system. In an embodiment, the feature lockout signal includes a communication to increase power consumption of at least one component of the x-ray imaging system.

Certain embodiments of the present invention provide a system for providing power to an x-ray imaging system including: a power source selector having at least two inputs for receiving electricity from a first power source and a second power source, at least one output connectable to a power supply of the x-ray imaging system, and at least one switch for routing electricity from one of the at least two inputs to the at least one output; and a power module capable of sensing an electrical signal from the second power source, and responsively controlling the switch of the power source selector and a feature lockout signal. In an embodiment, the power module further includes a safety sensor for sensing the presence of a connector from the first power source, and wherein the power module is capable of invoking a safety mode based on the status of the safety sensor. In an embodiment, the switch includes a relay. In an embodiment, an average voltage of the first power source is greater than an average voltage of the second power source. In an embodiment, the feature lockout signal includes at least one of: a communication to limit maximum power consumption of at least one component of the x-ray imaging system; a communication to permit maximum power consumption of at least one component of the x-ray imaging system. In an embodiment, the communication to limit maximum power consumption includes a communication to disable at least one component of the x-ray imaging system components. In an embodiment, the power module is capable of sensing a voltage of the electrical signal. In an embodiment, substantially all current flowing from the second power source is capable of flowing through the power module.

Certain embodiments of the present invention provide a computer-readable storage medium including a set of instructions for a computer, the set of instructions including: a sensing routine for sensing an electrical signal from a second power source; and a routing routine for switching at least one switch in response to the sensing routine, wherein the at least one switch is capable of routing electricity to an x-ray imaging system from at least one of: a first power source and the second power source. In an embodiment, the set of instructions further includes a communications routine for communicating a feature lockout signal to the x-ray imaging system in response to the sensing the electrical signal from the second power source. In an embodiment, the set of instructions further includes a detecting routine for detecting the status of a safety sensor before executing the routing routine. In an embodiment, the feature lockout signal includes at least one of: a communication to limit maximum power consumption of at least one component of the x-ray imaging system; a communication to permit maximum power consumption of at least one component of the x-ray imaging system.

Figure 1:
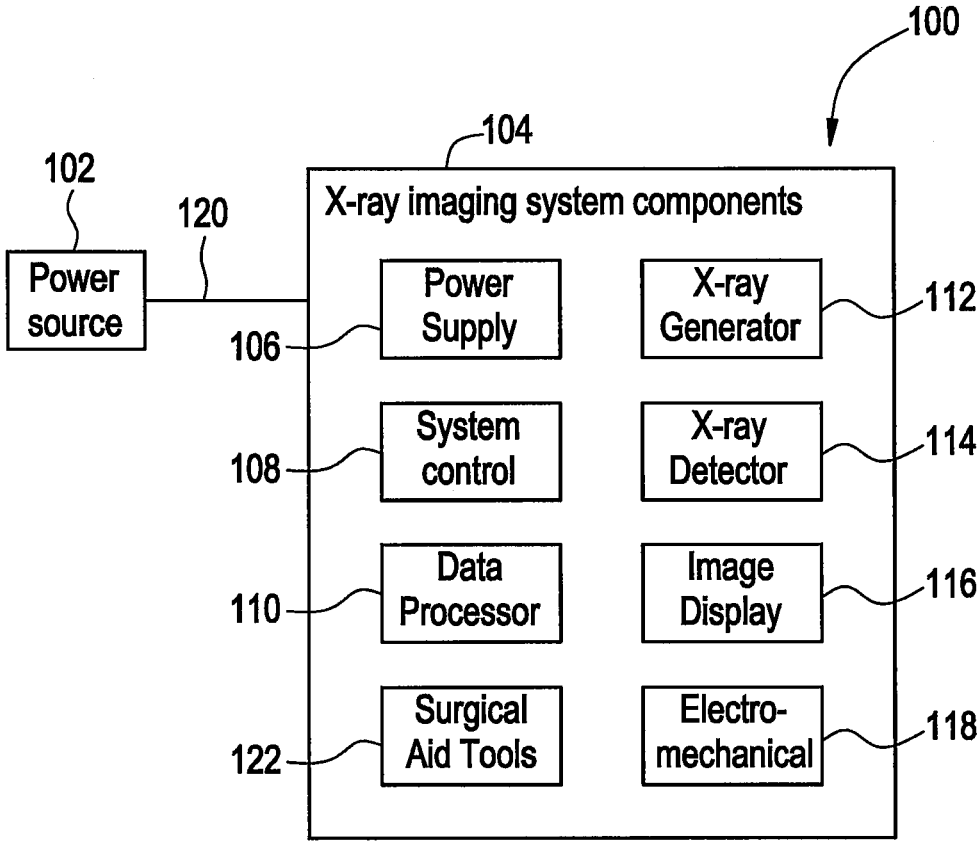
FIG. 1 shows an x-ray imaging system in accordance with an embodiment of the present invention.

The foregoing summary, as well as the following detailed description of certain embodiments of the present application, will be better understood when read in conjunction with the appended drawings. For the purpose of illustrating the invention, certain embodiments are shown in the drawings. It should be understood, however, that the present invention is not limited to the arrangements and instrumentality shown in the attached drawings.

DETAILED DESCRIPTION OF THE INVENTION

FIG. 1 shows an x-ray imaging system 100 in accordance with an embodiment of the present invention. The x-ray imaging system includes x-ray imaging system components 104. The components 104 may include a power supply 106, system control 108, data processor 110, x-ray generator 112, x-ray detector 114, image display 116, and/or electromechanical components 118, surgical aid tools 122, for example. X-ray generator 112 may include an x-ray generation power supply and other components for generating x-rays, for example. Electro-mechanical components 118 may include one or more motors for positioning an x-ray generator 112 and detector 114 along a C-arm, for example. Data processor 110 may include one or more CPUs and/or other processors, for processing x-ray image data, for example. X-ray detector 114 may include a solid state x-ray detector and a cooling system, for example. Image display 116 may include a printer, cathode-ray tube, flat panel monitor, LCD monitor, LED display, and/or other devices capable of displaying an image. System control 108 may include switches, inputs, outputs, CPUs and/or the like for controlling the overall operation of an x-ray imaging system 100. Surgical aid tools 122 may include surgical navigation systems which are integrated into the imaging components and are composed of transmitters/receivers and processors, for example. Further, a power supply 106 may be capable of providing power to some or all of the other x-ray imaging system components. The x-ray imaging system 100 may be implemented in hardware, software, and/or firmware.

The x-ray imaging system components 104 are connectable through a connection 120, such as a power cord, to a power source 102. A power source may be an AC power source, such as a 115, 208, 230, 277, or 480 VAC power source. A power source may also be a DC power source. A power source may be connectable to a connection 120 through an interface such as an outlet. A power source may be current limited based on a fuse, circuit breaker, and/or the like. Additionally, a power source may have a maximum current rating based on factors such as the type of outlet, gauge of wire, type of wire coating, ambient heating, and/or other factors. Similarly, a connection 120 may also have a maximum current rating and/or a current limitation (inline fuse, for example). For a variety of reasons, it may be desirable to keep the current draw of an x-ray imaging system 100 within the current ratings and limitations of a power source 102 and connection 120.

Figure 2:
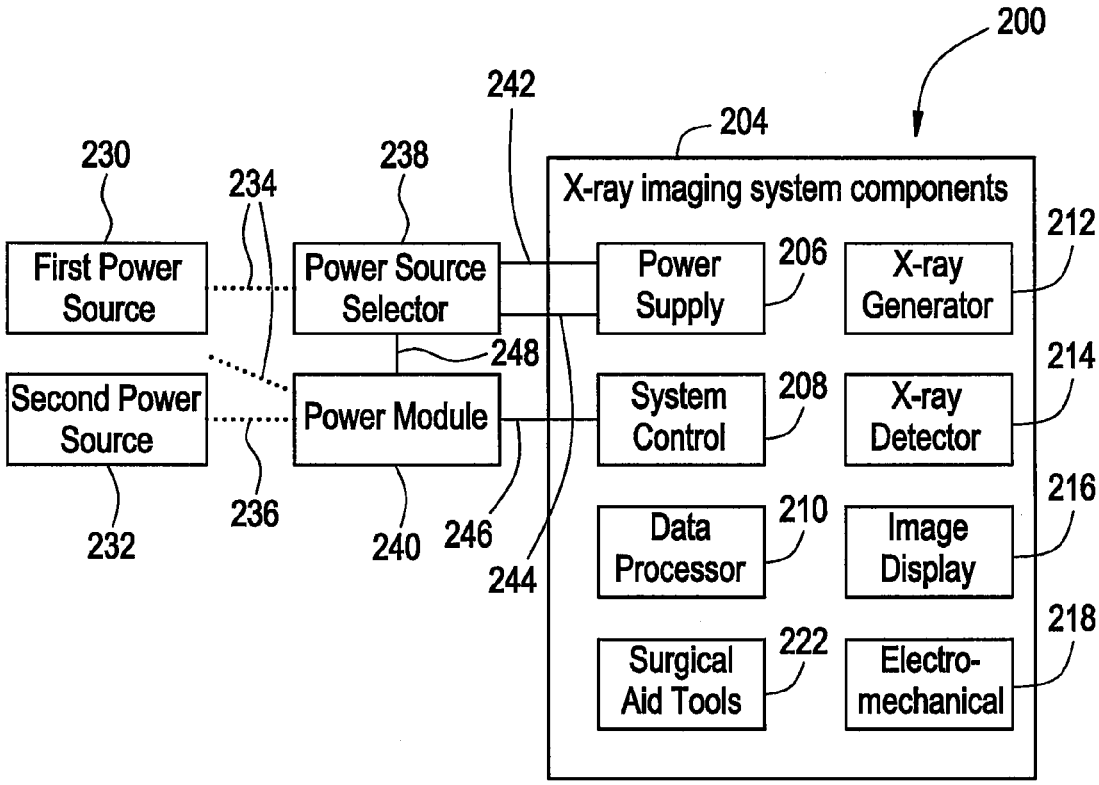
FIG. 2 shows an x-ray imaging system in accordance with an embodiment of the present invention.

FIG. 2 shows an x-ray imaging system 200 according to an embodiment of the present invention. X-ray imaging system 200 may include x-ray imaging system components 204, similar to x-ray imaging system components 104 shown in FIG. 1. For example, x-ray imaging system components 204 may include a power supply 206, system control 208, data processor 210, x-ray generator 212, x-ray detector 214, image display 216, and electromechanical components 218. Some functions of x-ray imaging system components 204 may be similar to the function of x-ray imaging system components 104 (shown in FIG. 1). System 200 may be implemented in hardware, software, and/or firmware.

Furthermore, system 200 may include a first power source 230 and/or a second power source 232. Each of the first and second power sources 230, 232 may be similar to power source 102 (shown in FIG. 1). The first power source 230 may be of a different type than the second power source 232.

For example, the first power source 230 may be a 208 VAC power source, and the second power source 232 may be a 115 VAC power source. Additionally, the first power source 230 may have a different receptacle type than the second power source 232. The type of receptacle may be regulated by UL/CSA/IEC/EN60601-1. The first power source 230 may be able to provide a different amount of maximum power than the second power source 232. For example, the first power source 230 may be able to provide more maximum power than the second power source 232.

The first power source 230 may be connectable through a connection 234 to a power source selector 238 and/or power module 240. The connection 234 may have a plug portion for interfacing with the power source 230 and a female socket portion for interfacing with either of power source selector 238 and power module 240. One reason for allowing the connection 234 to interface with power module 240 is for safety purposes, as will be further explained. The plug and socket portions of connector 234 may be regulated by UL/CSA/IEC/EN60601-1. For example, plug and socket portions of connector 234 may be rated for carrying 15 Amps, 20 Amps or 30 Amps at 208 VAC.

The second power source 232 may be connectable through a connection 236 to power module 240. The second power source 232 may also be connectable to the power source selector 238. The connection 236 may have a plug portion for interfacing with the power source 232 and a female socket portion for interfacing with power module 240. The plug and socket portions of connector 236 may be regulated by UL/CSA/IEC/EN60601-1. For example, plug and socket portions of connector 234 may be rated for carrying 15 Amps or 20 Amps at 115 VAC.

Power source selector 238 and power module 240 may be connected by a connector 248. Connector 248 may include multiple types of conductors, as will be further explained. Power source selector 238 and power module 240 may be integrated into a single unit, or may be distributed in to two or more portions. The power source selector 238 may contain one or more switches capable of routing electricity to power supply 206. Each switch may include mechanical components, such as an electromechanical relay and toggle switch, and/or solid state components, such as solid state relays, field effect transistors, and optoelectronic devices, for example.

In an embodiment, the switch includes one or more relay. The switch may have an open and a closed position. The open and closed positions may be toggled by applying a control signal (such as a relatively low AC or DC voltage) to the switch. When there is no control signal at the switch, the switch may be open (i.e. normally open). When the switch is open, electricity may be conductible from the first power source 230, through connector 234, into power source selector 238, through the switch, through connector 242, and into power supply 206. When a control signal is applied to the switch, the switch may become closed. When the switch is closed, electricity may be conductible from the second power source 232, through connector 236, into power module 240, through corresponding conductors in connector 248, into power source selector 238, through the switch, through connector 244, and into power supply 206. Of course, alternative switching schemes are possible—for example, the sense of the switch may be reversed (e.g. normally closed), and the open and closed paths may be reversed.

Power module 240 may be capable of controlling the switch(es) in power source selector through one or more control signals. The control signals may be delivered through corresponding conductors in connection 248. Alternatively, control signals may be provided through a wireless, infrared, or optical connection (not shown). In an embodiment, power module 240 "senses" that power is being provided from the second power source 232, through the connector 236. For example, power module 240 may sense an electrical signal from the second power source 232 through a voltage sensor, a voltage sensitive relay, a voltage comparator, an analog to digital converter or a mechanical sensor at second power source closing a contact. When an electrical signal from the second power source 232 is detected, the power module 240 may cause the switch in power source selector 238 to conduct current from the second power source 232 to the power supply 206. Substantially all of the current may be routed through the power module 240, or may not pass directly through the power module 240. For example, current may be routed from the second power source 232 through connector 236 and into power source selector 238. Additional connectors may be provided such that the power module 240 may sense power from the second power source 232 without having substantially all current pass through the power module 240. Similarly, if no electrical signal is detected from the second power source 232, the power module 240 may cause the power source selector 238 to route current from the first power source 230 to the power supply 206. The power module 240 may cause the power source selector 238 to route current by providing one or more control signal(s) or no control signal to the switch(es) in the power source selector 238, for example.

Current from the power source selector 238 may be provided to the power supply 206 through one or more connections 242, 244. In an embodiment, current from the first power source 230 is provided through one connection 242, and current from the second power source 232 is provided through a second connection 244. Correspondingly, the power supply 206 may be configured to power the x-ray imaging system components 204 based on input power from either connection 242 (the first power source 230) or connection 244 (the second power source 232). For example, power supply 206 may include a transformer tapped at different points on the primary coil, such that power from the first or second power sources 230, 232 may be convertible into power suitable for supplying x-ray imaging system components 204. In another embodiment, current from the first or second power sources 230, 232 may be supplied to the power supply 206 through a single connector, such as connector 242. In this embodiment, the power supply 206 may recognize the type of supply power, and may adapt accordingly.

Power module 240 may have a safety switch or safety sensor for detecting the presence of connector 234. Power module 240 may be configured to prevent the supply of power to power supply 206 (either through an internal break, or by controlling the power source selector 238) when the safety switch/sensor does not recognize connector 234. The safety switch/sensor may reduce the risk of having more than one power source, such as 230 and 232, electrically connected to the system 200 at the same time. The safety switch/sensor may also prevent dangerous back-fed voltages from appearing on connector 234 when power is being supplied from second power source 232. For example, power module 240 may have a port for receiving the connector 234. By mating connector 234 into the port, the safety switch/sensor may be actuated. The power module 240 may be capable of recognizing actuation of the safety switch/sensor through a micro-controller, for example.

There may be no further electrical connection downstream from the port, so current/power may not be conducted from connector 234 through power module 240. Power module 240 may then control power source selector 238 to provide power from the second power source 232 to the power supply 206. However, if the safety switch/sensor has not been actuated, the power module 240 may prevent power from being provided from the second power source 232 to the power supply 206. This may, for example, reduce the risk that back-fed voltages may appear on connector 234.

The power module 240 may also provide a feature lockout signal 246 to the system control 208, or to other components capable of receiving a feature lockout signal 246. The feature lockout signal 246 may vary based on whether the power module 240 recognizes that power is being supplied from the second power source 232. For example, the power module 240 may selectively assert/deassert a feature lockout signal 246 based on the detected presence of power from the second power supply 232.

The feature lockout signal 246 may communicate to system control 208 (or other components 204 configured to receive signal 246), that certain features in the x-ray imaging system 200 should be disabled, or modified to reduce power consumption. For example, certain components 204 may consume relatively large amounts of power. The components 204 that are power intensive may include x-ray generation 212, x-ray detection, 214, and electromechanical 218 components, for example. For example, the x-ray detection component 214 may include power-intensive cooling subsystems. By selectively disabling components 204 (or subsystems thereof), the overall power load of the system 200 may be reduced. By reducing the power load of the 200, it may be possible to operate the x-ray imaging system with certain features locked out though a reduced voltage power supply, such as the second power supply 232. For example, it may be possible to operate a reduced-feature x-ray imaging system 200 through a 115 VAC power supply at normally-available current ratings (e.g. 10, 15, or 20 Amps).

System control 208 and other components 204 capable of acting in response to the status of a feature lockout signal 246 may have software, hardware, and/or firmware capable of making decisions based on a status of the signal 246. For example, system control 208 may selectively disable other components 204 when the signal 246 indicates that features should be locked out. Other components 204, such as x-ray detection 214, may also be configured with software, hardware, and /or firmware capable of making decisions based on the status of the signal 246.

In an embodiment, components 204 may operate in a reduced power mode, rather than being completely disabled in response to the status of signal 246. For example, x-ray generation component 212 may operate in a reduced power mode, such as a pain management mode, in response to a status of signal 246. A reduced power mode for x-ray generation component 212 may operate by producing less energetic x-rays, on the whole, for example. Reduced energy x-rays may be sufficient for imaging cervical, thoracic and lumbar spines to guide needles to structures for pain treatment, a procedure typically done for pain management, for example.

In an embodiment, components 204 may be placed into a lockout mode, or a reduced power mode through manual intervention, hard-wiring, hardware or software configuration or the like. For example, jumpers, dip switches, and/or the like may be provided to place one or more components 204 into a lockout or reduced power mode.

System 200 may be capable of operating without any features disabled when powered by a power supply of 208 VAC, for example. When power is being supplied by a higher voltage power source, such as the first power source 230, the feature lockout signal 246 may be controlled by the power module 240, such that the signal 246 communicates that no features are to be locked from normal operation in system 200.

Figure 3:
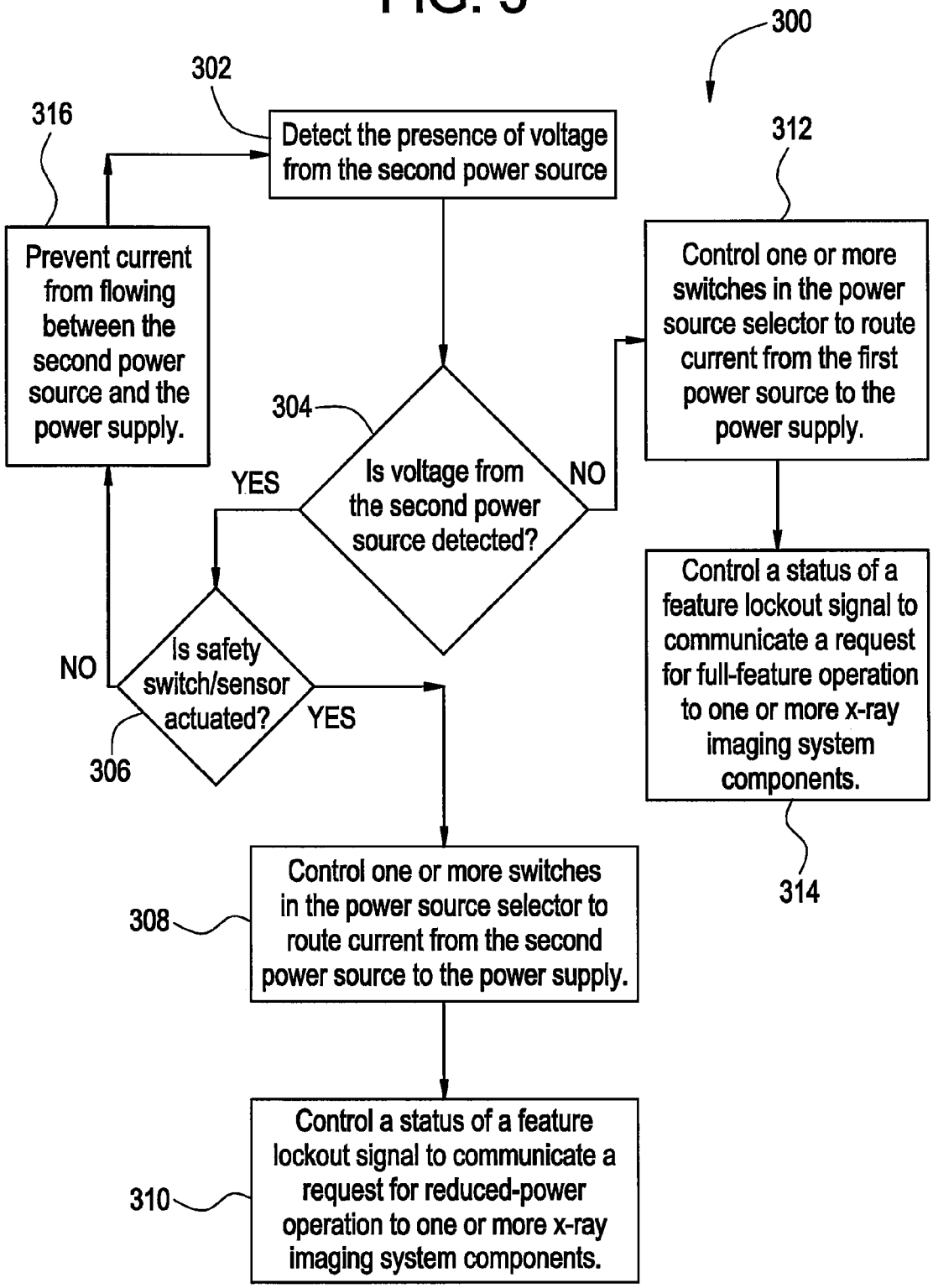
FIG. 3 shows a flowchart of a method for selectively providing power to x-ray imaging system in accordance with an embodiment of the present invention.

FIG. 3 shows a flowchart of a method 300 for selectively providing power to an x-ray imaging system, such as x-ray imaging system 200, in accordance with an embodiment of the present invention. The steps of method 300 may be performable, for example, by a power module, such as power module 240 (shown in FIG. 2). Furthermore, the steps of method 300 may be performable in a different order, or some steps may be omitted. For example, step 310, 314, and/or 316 may be omitted. Method 300, or a portion thereof, may be performable by one or more processing units. Method 300, or a portion thereof, may be performable by software, hardware, and/or firmware. Method 300, or a portion thereof, may also be expressible through a set of instructions stored on one of more computer-readable storage media, such as RAM, ROM, EPROM, EEPROM, optical disk, magnetic disk, magnetic tape, and/or the like.

At step 302, the presence of electrical signal from a second power source 232 is detected. Electrical signal may be detected through a voltage sensor, for example. A voltage sensor may include any of an analog to digital converter, a voltage comparator, voltage sensitive relay or a mechanical sensor closing a contact. The voltage sensor may be configurable to detect a specific AC or DC voltage. For example, the voltage sensor may detect 115 VAC. Alternatively, the voltage sensor may be capable of detecting a voltage within a range—e.g. 105-125 VAC. As another example, the voltage sensor may be capable of detecting voltage above or below a specific level. The voltage sensor may be able to detect peak voltage, RMS average voltage, and/or the like. The voltage sensor may be able to detect the period of oscillation of voltage on the line. The voltage sensor may be capable of filtering noise before detecting voltage.

At step 304, a decision may be made based on the detection of electrical signal at step 302. If a particular electrical signal is detected, such as a voltage between 105-125 VAC, from the second power source 232, then method 300 may flow to step 306. However, if a particular electrical signal is not detected, then method 300 may flow to step 312. Other options may also be possible. For example, if an excessively high voltage or otherwise unexpected voltage is detected at step 302, then step 304 may direct flow of method 300 to a safety shut-down mode (not shown), for example. Step 304 may perform time-averaging, to insure that a decision is accurate, and not just then result of a transient event.

If a electrical signal is being provided from the second power source 232, then method 300 may flow to step 306. At step 306 a safety switch/sensor may be polled or otherwise checked to determine if the switch/sensor has been actuated. The switch/sensor may be a physical switch, or may sense configuration changes through optical, magnetic, capacitive, and/or other methods. The switch/sensor may be actuated if a connector from a first power source, such as connector 234, has been mated with a complementary port, for example. By designing the system in this manner, method 300 may facilitate that a connector such as connector 234 will not connect the first power source 230 and the power source selector 238.

For example, when the x-ray system 200 is to be operated from the second power source 232, it may be necessary to disconnect the first power source 230 for safety reasons. However, merely disconnecting the connector 234 from the first power source 230 may still pose a danger. For example, voltage may be back-fed from the second power source 232 to the connector 234 which may be exposed, because one end of the connector 234 may no longer be safely mated with the first power source 230. Causing one end of the connector 234 to be mounted in the power module 240, and not the power source selector 238 may prevent at least two dangers: (1) the mounting port on the power module 240 may be electrically isolated or disconnected from the rest of the system, thus preventing substantial current from flowing through connector 234 into the rest of the system 200; (2) when connector 234 is disconnected from the power source selector 238, there may be a reduced risk of having back-fed voltages appearing on an exposed portion of connector 234.

If the safety switch/sensor is actuated, then method 300 may flow to step 308. At step 308, one or more switches in the power source selector 238 may be controlled to route power from the second power source 232 to the power supply 206. In an embodiment, the switch includes one or more relay. The switch may have an open and a closed position. The open and closed positions may be toggled by applying a control signal (such as a low AC or DC voltage) to the switch. When there is no control signal at the switch, the switch is open (i.e. normally open). When the switch is open, electricity may be conductible from the first power source 230, through connector 234, into power source selector 238, through the switch, through connector 242, and into power supply 206. When a control signal is applied to the switch, the switch may become closed. When the switch is closed, electricity may be conductible from the second power source 232, through connector 236, into power module 240, through corresponding conductors in connector 248, into power source selector 238, through the switch, through connector 244, and into power supply 206, for example. Of course, alternative switching schemes are possible—for example, the sense of the switch may be reversed, and the open and closed paths may be reversed.

It may further be possible to control the switch(es) in power source selector through, for example, one or more control signals. The control signals may be delivered through corresponding conductors in connection 248. Alternatively, control signals may be provided through a wireless, infrared, or optical connection (not shown). If a electrical signal is detected at step 302, the power module 240 may cause the switch in power source selector 238 to conduct power from the second power source 232 to the power supply 206, for example.

After step 308, method 300 may flow to step 310. At step 310, a status of a feature lockout signal may be controlled to communicate a request for reduced-power operation to one or more x-ray imaging system components 204. A feature lockout signal may be similar to feature lockout signal 246 described in conjunction with system 200. The feature lockout signal may be provided to a system control (such as system control 208), or to other components capable of receiving a feature lockout signal. The feature lockout signal may communicate to system control (or other components configured to receive a feature lockout signal), that certain features in the x-ray imaging system 200 should be disabled, or modified to reduce power consumption. For example, certain components are known to consume relatively large amounts of power. Components that are power-intensive may include x-ray generation, x-ray detection, and electro-mechanical components, similar to those shown in system 200. For example, the x-ray detection component may include power-intensive cooling sub-systems. By selectively reducing power consumption in components and/or sub-systems that are power intensive, the overall maximum power load of an x-ray imaging system may be reduced. By reducing the maximum power load of the system, it may be possible to operate the x-ray imaging system with certain features locked out through a reduced voltage power supply, such as the second power supply 232. For example, it may be possible to operate a reduced-feature x-ray imaging system through a 115 VAC power supply at normally-available current ratings (e.g. 10, 15, or 20 Amps).

If the safety switch/sensor is not actuated, then method 300 may flow to step 316. At step 316, current may be prevented from flowing between the second power supply source and the power supply. Step 316 may operate in a manner similar to step 312, so that power is routed from the first power source 230 to the power supply 206. Step 316 may also have other fail-safe modes of operation, such as one or more additional safety relays or other current-flow switches and/or prevention devices. Such switches or prevention devices may be located in power source selector 238, power module 240, and/or power supply 206, for example. Step 316 may take advantage of a communication signal, such as feature lockout signal 246, to communicate to x-ray imaging components not to draw power, for example. As another example, a power supply, such as power supply 206, may include a microprocessor capable of controlling power supply operations, and step 316 may cause a signal to be communicated to a power supply to prevent current draw. After step 316, method 300 may flow back to step 302, for example.

If an electrical signal is not being provided from the second power source 232, then method 300 may flow to step 312. At step 312, if an electrical signal is not detected from the second power source 232, the power module 240 may cause the power source selector 238 to route power from the first power source 230 to the power supply 206. The power module 240 may cause the power source selector 238 to route power by providing one or more control signal(s) or no control signal to the switch(es) in the power source selector 238, for example. Step 312 may be performable by an affirmative act, or step 312 may be performable by not taking any action (e.g. if a relay switch is already in a position to route current from the first power source 230 to the power supply 206).

After step 312, method 300 may flow to step 314. At step 314, a status of a feature lockout signal may be controlled to communicate a request for reduced-power operation to one or more x-ray imaging system components. A feature lockout signal may be similar to feature lockout signal 246 described in conjunction with system 200. The feature lockout signal may be provided to a system control (such as system control 208), or to other components capable of receiving a feature lockout signal. The feature lockout signal may communicate to system control (or other components configured to receive a feature lockout signal), that certain features in the x-ray imaging system 200 should be enabled, or should be able to operate without reduced power consumption concerns. Through the feature lockout signal, it may be possible to communicate to the x-ray imaging system to return to full power consumption mode.

As an illustrative example, method 300 may be performed in the following manner. An x-ray imaging system 200 is capable of being powered through both a 208 VAC power supply (first power source 230), and a 115 VAC power supply (second power source 232). However, a commonly available 20 Amp circuit at 115 VAC will not provide sufficient power to allow the x-ray imaging system to draw a maximum power. Nonetheless, it may be useful to operate the x-ray imaging system in a power-reduced mode through the 115 VAC source. For example, it may be useful to show some features of the x-ray imaging system at a trade show, or on a sales floor where 208 VAC may not be available. Alternatively, it may be useful to have reduced power for clinical applications, such as pain management imaging.

To operate the x-ray imaging system 200 in full-power mode, power is supplied from the first power source 230 to a power source selector 238. The first power source 230 provides a voltage of approximately 208 VAC, at 20 Amps, corresponding to a maximum possible power of approximately 4160 Watts (=Voltage*Current). For the purposes of this example, 4160 Watts is sufficient to operate the x-ray imaging system 200 in full-power mode. At step 302, the power module 240 does not detect a electrical signal coming from the second power source, because it is not hooked up. In response, at steps 304 and 312, the power module 240 controls the power source selector 238 to route current from the first power source 230 to the power supply 206. At step 314, the power module 240 also communicates to the system control 208 vis-à-vis the feature lockout signal 246. The power module 240 communicates through the feature lockout signal 246 that the x-ray imaging components 204 are to operate in full-power mode. The system control 208 receives this instruction, and causes the x-ray imaging components 204 to operate in full-power mode.

To operate the x-ray imaging system 200 in a reduced-power mode, power is supplied from the second power source 232 to a power module 240. The second power source 232 provides a voltage of approximately 115 VAC, at 20 Amps corresponding to a maximum possible power of approximately 2300 Watts (=Voltage*Current). In this example, 2300 Watts is sufficient to operate the x-ray imaging system if the x-ray generation 212 and x-ray detection 214 components are disabled. In reduced-power mode, the x-ray imaging system 200 will have a working display, data processing, and electromechanical components (210, 216, 218), but will not otherwise be able to generate x-ray images.

To supply the x-ray system 200 with 115 VAC, a user has disconnected one end of the connector 234 from the first power source 230, and has connected another end of connector 234 into a mating port on the power module 240. Further, the user has connected the second power source 232 (capable of supplying 115 VAC@ 20 Amps) to the power module 240 through connector 236. At step 302, the power module 240 detects the presence of 115 VAC from the second power source. In response, at steps 304 and 306, the power module 240 checks the status of the safety switch. Because connector 234 has been fitted into the mating port on power module 240, the switch has been actuated. Therefore, method 300 flows to step 308. At step 308, the power module 240 controls through a control signal a relay in the power source selector 238. The relay is switched such that current may now flow from the second power source 232, through the power module 240, into the power source selector 238, and to the power supply 206. Additionally, at step 310, the power module 240 also communicates to the system control 208 vis-à-vis the feature lockout signal 246. The power module 240 communicates through the feature lockout signal 246 that the x-ray imaging components 204 are to operate in reduced-power mode. The system control 208 receives this instruction, and causes the x-ray imaging components 204 to operate in reduced-power mode by disabling the x-ray generation component 212 and the x-ray detection component 214.

In an embodiment, x-ray imaging system 200 includes a computer-readable medium, such as a hard disk, floppy disk, CD, CD-ROM, DVD, compact storage, flash memory and/or other memory. The medium may be in power module 240, power source selector 238, system control 208 and/or in other components 204 or systems. The medium may include a set of instructions capable of execution by a computer or other processor. The functions in method 300 described above may be implemented, at least in part, as instructions on the computer-readable medium.

For example, the set of instructions may include a sensing routine for sensing the presence of an electrical signal from a power source, such as the second power source 232 (shown in FIG. 2). The sensing routine may facilitate implementation of steps 302 and/or 304, described above in conjunction with method 300. The sensing routine may facilitate other aspects of system 200 and method 300 described above. For example, the sensing routine may be able to process input data to determine if an average voltage between 110-120 is being provided from the second power source 232.

Additionally, the set of instructions may include a routing routine that controls switching of a switch in, for example, the power source selector 238 (shown in FIG. 2). The switching routine may be able to facilitate implementation of steps 312, 308 and/or 316 described above in conjunction with method 300. The routing routine may facilitate other aspects of system 200 and method 300 described above. For example, the routing routine may be able to initiate the provision of a control signal to control a relay located in the power source selector 238 to switch on and off.

Furthermore, the set of instructions may include a communications routine that controls at least a portion of the content of a signal, such as a feature lockout signal 246 (shown in FIG. 2). The signal may be communicated to x-ray imaging components, such as components 204 shown in FIG. 2. The communications routine may facilitate implementation of steps 310 and/or 314 described above in conjunction with method 300. The communications routine may facilitate other aspects of system 200 and method 300 described above. For example, the communications routine may cause a feature lockout signal 246 to communicate to system control 208 that the x-ray imaging system is to operate at a full power mode and/or a reduced power mode.

In an embodiment, the set of instructions may further include a detecting routine for detecting the status of a safety sensor. The detecting routine may facilitate implementation of steps 316 and/or 306, described above in conjunction with method 300. The sensing routine may facilitate other aspects of system 200 and method 300 described above. For example, the sensing routine may be able to process input data to determine if a safety switch has been actuated, thereby indicating that connector 234 has been mated with a mating port on power module 240.

Additional embodiments of the present invention may also be possible. For example, it may be possible to adapt system 200 and/or method 300 in such a manner to allow the system 200 to receive power from both of the first and second power sources 230, 232 as needed. For example, if the system 200 requires more power, it may be possible to adaptively switch over to the first power source 230, or to add a second power source 232 in addition to the first power source 230.

Another possible embodiment is the incorporation of wirelessly coupled power. In this embodiment(s), it may be possible to transmit at least a portion of the power carrying electrical signals through wireless connections instead of through conductive connectors (such as connectors 234, 236, 248, 242, and 244, for example). Wirelessly coupled power may be provided through electromagnetic field generated power systems, for example, or through optical energy transmission methods.

Thus, embodiments of the present application provide methods and systems that generally improve the geographical penetration of mobile x-ray imaging systems. Embodiments of the present application provide for methods and systems that flexibly provide electrical power to an x-ray imaging system based on the availability of various electrical power sources. Additionally, embodiments of the present application provide methods and systems that automatically recognize a type of power source (e.g. 115 or 208 VAC) that is being used to power an x-ray imaging system. Moreover, embodiments of the present application provide methods and systems that prevent x-ray imaging systems from overdrawing power beyond the capacity of an available power source.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. For example, features may be implemented with software, hardware, or a mix thereof. Therefore, it is intended that the invention not be limited to the particular embodiment disclosed, but that the invention will include all embodiments falling within the scope of the appended claims.

The invention claimed is:

1. A method for providing power to an x-ray imaging system comprising:

sensing an electrical signal from a second power source;

routing said electrical signal from said second power source through at least one switch to an x-ray imaging system in response to said sensing an electrical signal from said second power source, wherein said at least one switch is configured to route an electrical signal from at least one of: a first power source and said second power source; and communicating a feature lockout signal to said x-ray imaging system in response to said sensing said electrical signal from said second power source.

2. The method of claim 1 further comprising detecting the status of a safety sensor before routing said electrical signal from said second power source through said at least one switch.

3. The method of claim 1, wherein a power module is configured to perform said sensing said electrical signal from said second power source.

4. The method of claim 1, wherein a power module is configured to commumcate said feature lockout signal.

5. The method of claim 1, wherein said routing said electrical signal from said second power source through at least one switch is performable by at least one of: applying a control signal to one of said at least one switch; and removing said control signal from one of said at least one switch.

6. The method of claim 1, wherein said first power source is configured to source more power than said second power source.

7. The method of claim 1, wherein an average voltage of said first power source is greater than an average voltage of said second power source.

8. The method of claim 1, wherein said feature lockout signal comprises a communication to reduce power consumption of at least one component of said x-ray imaging system.

9. The method of claim 1, wherein said feature lockout signal comprises a communication to increase power consumption of at least one component of said x-ray imaging system.

10. A system for providing power to an x-ray imaging system comprising:

a power source selector having at least two inputs for receiving electricity from a first power source and a second power source, at least one output connectable to a power supply of the x-ray imaging system, and at least one switch for routing electricity from one of said at least two inputs to said at least one output; and a power module configured to sense an electrical signal from said second power source, and responsively controlling said switch of said power source selector and a feature lockout signal.

11. The system of claim 10, wherein said power module further comprises a safety sensor for sensing the presence of a connector from said first power source, and wherein said power module is configured to invoke a safety mode based on the status of said safety sensor.

12. The system of claim 10, wherein said switch comprises a relay.

13. The system of claim 10, wherein an average voltage of said first power source is greater than an average voltage of said second power source.

14. The system of claim 10, wherein said feature lockout signal comprises at least one of: a communication to limit maximum power consumption of at least one component of the x-ray imaging system; a communication to permit maximum power consumption of at least one component of said x-ray imaging system.

15. The system of claim 14, wherein said communication to limit maximum power consumption comprises a communication to disable at least one component of said x-ray imaging system components.

16. The system of claim 10, wherein said power module is configured to sense a voltage of said electrical signal.

17. The system of claim 10, wherein substantially all current flowing from said second power source is configured to flow through said power module.

18. A computer-readable storage medium including a set of instructions for a computer, the set of instructions comprising:

a sensing routine for sensing an electrical signal from a second power source;

a routing routine for switching at least one switch in response to said sensing routine, wherein said at least one switch is capable of routing electricity to an x-ray imaging system from at least one of: a first power source and said second power source; and a communications routine for communicating a feature lockout signal to said x-ray imaging system in response to said sensing said electrical signal from said second power source.

19. The set of instructions of claim 18 further comprising a detecting routine for detecting the status of a safety sensor before executing said routing routine.

20. The set of instructions of claim 18, wherein said feature lockout signal comprises at least one of: a communication to limit maximum power consumption of at least one component of said x-ray imaging system; a communication to permit maximum power consumption of at least one component of said x-ray imaging system.

* * * * *